US007950909B2

(12) United States Patent
Chang

(10) Patent No.: US 7,950,909 B2
(45) Date of Patent: May 31, 2011

(54) PUMP STRUCTURE CONNECTABLE WITH AN AIR CUSHION OR A BLADDER

(76) Inventor: Chi-Yuan Chang, Taichung County (TW)

( * ) Notice: Subject to any disclaimer, the term of this patent is extended or adjusted under 35 U.S.C. 154(b) by 69 days.

(21) Appl. No.: 12/379,129

(22) Filed: Feb. 13, 2009

(65) Prior Publication Data

US 2009/0155098 A1 Jun. 18, 2009

Related U.S. Application Data

(63) Continuation of application No. 11/232,942, filed on Sep. 23, 2005, now abandoned.

(51) Int. Cl.
*F04B 43/00* (2006.01)

(52) U.S. Cl. ..... 417/480

(58) Field of Classification Search ..... 417/437, 417/478, 479, 480; 137/223, 596, 846; 5/708, 5/713

See application file for complete search history.

(56) References Cited

U.S. PATENT DOCUMENTS

| | | | | | |
|---|---|---|---|---|---|
| 5,257,470 | A * | 11/1993 | Auger et al. | 36/88 |
| 5,460,200 | A * | 10/1995 | Glicksman | 137/512.4 |
| 5,846,063 | A * | 12/1998 | Lakic | 417/440 |
| 5,860,441 | A * | 1/1999 | Garcia | 137/15.18 |
| 6,461,125 | B1 * | 10/2002 | Terasawa et al. | 417/479 |
| 2004/0055640 | A1 * | 3/2004 | Dojan et al. | 137/223 |

* cited by examiner

*Primary Examiner* — Devon C Kramer
*Assistant Examiner* — Dnyanesh Kasture
(74) *Attorney, Agent, or Firm* — Muncy, Geissler, Olds & Lowe, PLLC

(57) ABSTRACT

A pump structure connectable with an aircushion or a bladder. The pump structure includes: a flexible main body defining a valve room in which a relief valve is arranged and a compressible chamber; a one-way valve permitting the fluid to one-way flow into the chamber; and a thin membrane-type check valve. The check valve has a first end and a second end, which are operable between opened position and closed position. The first and second ends respectively communicate with the chamber and an output tube, which is connectable with the aircushion or bladder. The first and second ends of the check valve are respectively positioned in spaces provided by the chamber and the valve room. A substrate board is disposed under the flexible main body. The substrate board has a through hole and a notch formed on positions where the first and second ends of the check valve are formed.

19 Claims, 9 Drawing Sheets

PUMP STRUCTURE CONNECTABLE WITH AN AIR CUSHION OR A BLADDER

CROSS-REFERENCE TO RELATED APPLICATION

This application is a continuation-in-part application of U.S. patent application Ser. No. 11/232,942.

BACKGROUND OF THE INVENTION

The present invention relates to a pump structure connectable with an aircushion or a bladder. The pump structure is composed of a flexible main body defining a chamber and a valve room, a thin membrane-type check valve and a substrate board having a through hole and a notch. The chamber is reciprocally compressible and decompressible to pump a fluid for inflating the aircushion or bladder.

A pump is used to pump fluid (gas or liquid) into a cushion or a bladder to form an elastic article such as inflatable mattress, inflatable pillow, inflatable toy, cushion pad, etc. When not used, these inflatable articles can be deflated and stored. U.S. Pat. No. 5,144,708, entitled "check valve for fluid bladders" discloses a technique for combining a bladder with an inflation pump. The bladder is composed of an upper sheet body and a lower sheet body, which define two chambers and a fluid passage between the two chambers. The bladder is equipped with a check valve. The check valve includes two layers of plastic membranes with the same length. The two layers of plastic membranes are disposed in the fluid passage to face inner faces of the upper and lower sheet bodies. A shield material is laid on inner surfaces of the plastic membranes. When the plastic membranes are thermally fused with each other, a space is formed, whereby the check valve can extend between the upper and lower sheet bodies. The two layers of plastic membranes define a duct through which a fluid is able to one-way flow from one chamber to the other chamber of the bladder.

U.S. Pat. No. 5,846,063 discloses an air pump device, which can be reciprocally compressed and decompressed to deliver a fluid. The air pump device includes a hard bottom board. A hook-and-loop fastener and a compressible chamber are arranged on the bottom board. A one-way valve and a coupling tube are mounted on one side of the chamber. The one-way valve permits air to one-way flow into the chamber, while the coupling tube permits air to flow out of the chamber. The other end of the coupling tube is disposed in a case. A check valve is disposed in the case opposite to the coupling tube. In addition, a relief valve and an output tube are mounted on the case. The air is output through the coupling tube, the check valve and the case.

The difference between U.S. Pat. No. 5,144,708 and U.S. Pat. No. 5,846,063 is that the check valves are made of different materials and have different structures. Also, the structural designs of the relevant components are different. For example, U.S. Pat. No. 5,144,708 employs a flexible material to form the pump device. Therefore, the pump device is soft, safe and lightweight. Moreover, the pump device has a flat configuration and is easy to fold and carry. Such pump device can be only fixed inside a specific inflatable cushion/bladder or installed on a periphery thereof. That is, such pump device is only applicable to a specific inflatable cushion/bladder adapted to the pump device. Therefore, it is impossible to flexibly use the pump device to inflate any other aircushion or bladder. Accordingly, the application range of such pump device is quite limited. In general, the pump device can be only used to inflate an inflatable mattress, inflatable pillow, cushion pad or the like.

On the other hand, in operation of such pump device, in case the thin membrane-type check valve is incautiously slightly bent, the airflow will be unable to smoothly flow. Under such circumstance, the air passage will be blocked to result in malfunction of the pump device. It is also found that in inflation operation of the pump device, which is made of soft or flexible material, the pump structure is likely to irregularly bend or fold due to pressing of an operator's fingers in different positions and different attitudes. This will affect the inflation efficiency of the pump device or even lead to malfunction of the pump device.

U.S. Pat. No. 5,846,063 employs hard/rigid material to form the air pump. For example, the bottom board, the coupling tube, the check valve and the case are made of hard material. In comparison with U.S. Pat. No. 5,144,708, almost every components of the substantially metal-made air pump device are rigid. In other words, it is impossible to flex the air pump to change its height or volume. Therefore, such air pump has larger height and volume and heavier weight and is inconvenient to carry. However, such air pump is not subject to bending so that it is free from the problem of unsmooth airflow or malfunction. Therefore, such air pump can be more accurately operated and the application range of such air pump is wider. Especially, the air pump has an output tube connectable to some other inflatable products (such as sport implements, sport shoes and bicycle saddles). However, when the substantially metal-made air pump is connected with a sport implement, it should be taken into consideration that the air pump may bound away or detach from the sport implement to damage the same or hurt a user or other persons.

As well known to those skilled in this field, the pump devices or air pumps made of different materials (flexible or rigid materials) and designed with different structures have different advantages and defects respectively. Therefore, there are some issues on the use of these pump devices or air pumps that should be discussed. For example, the safety in use of these pump devices or air pumps must be considered, especially when applied to sport implements. It is not preferred to make the pump device from too many hard/rigid materials. However, in the case that the pump device is made of flexible material and includes thin membrane-type check valve, the pump device is likely to malfunction due to folding and unsmooth airflow as aforesaid. It is critical how to solve the above problems existing in the prior art.

It is therefore tried by the applicant to provide a pump structure to obviate the above problems. The pump structure of the present invention is able to ensure safety in use of the pump device and eliminate the shortcomings existing in the prior art. The pump structure of the present invention has the following characteristics:

1. The fluid passage defined by the thin membrane-type check valve will not be bent in inflation or pressing operation. Therefore, the intake and exhaustion of air will not be affected.
2. The intake and exhaustion of air is achieved by means of opening/closing operation of two thin membranes of the thin membrane-type check valve. The intake and exhaust port of the thin membrane-type are positioned at a sufficient height or with a sufficient space to allow the opening/closing operation. Moreover, even if the pump device is incautiously bent in operation, the variation of the height or space is minimized.
3. The pump device is made of flexible material, which is not too soft. Therefore, the strength of the pump device will not be weakened and thus the pump device is not subject to damage. Also, the bottom of the pump has a sufficient strength for bearing the pressure exerted by an operator's fingers onto the pump device in inflation operation. Therefore, the affection on inflation efficiency of the pump device can be minimized.

4. In the prior art, the thin membrane-type check valve can be hardly applied to those air pumps made of rigid material (as disclosed in U.S. Pat. No. 5,846,063). This is because the thin membrane-type check valve has such a structure that it is impossible to combine the thin membrane-type check valve with the case of the air pump. This problem is solved in the present invention.

SUMMARY OF THE INVENTION

It is therefore a primary object of the present invention to provide a pump structure connectable with an aircushion or a bladder. The pump structure includes: a flexible main body defining a valve room in which a relief valve is arranged and a compressible chamber; a one-way valve permitting the fluid to one-way flow into the chamber; and a thin membrane-type check valve. The check valve has a first end and a second end, which are operable between opened position and closed position. The first and second ends respectively communicate with the chamber and an output tube. The output tube is connectable with the aircushion or bladder for delivering the fluid coming from the chamber into the aircushion or bladder. The relief valve is positioned above the second end of the check valve and communicates with the output tube to serve as a relief passage.

It is a further object of the present invention to provide the above pump structure in which the first and second ends of the check valve are respectively positioned in spaces provided by the chamber and the valve room. The first and second ends of the check valve can be operated between opened and closed positions in the spaces without interference. A substrate board is positioned under the flexible main body and formed with a through hole and a notch. The through hole and the notch are formed in positions where the first and second ends the check valve are formed. This helps in keeping the spaces provided by the flexible main body unchanged so as to avoid malfunction of the pump due to unsmooth airflow or other factors.

It is still a further object of the present invention to provide the above pump structure in which the flexible main body includes an upper layer and a bottom layer, which together define the chamber and the valve room. The thin membrane-type check valve is sandwiched between the upper layer and the bottom layer of the flexible main body. The first end the check valve extends into the chamber to communicate therewith. The bottom layer has the form of a thin membrane. The bottom layer of the flexible main body has a thickness smaller than that of the upper layer. Such structure is different from the rigid material-made case and the check valve mounted therein of the conventional pump. Accordingly, the danger caused by the rigid components to the aircushion/bladder or people can be minimized.

It is still a further object of the present invention to provide the above pump structure in which the through hole and notch of the substrate board provide spaces into which the bottom layer of the flexible main body can be recessed. Therefore, the first and second ends of the thin membrane-type check valve can be opened/closed without interference. Even though the flexible main body is bent, by means of the through hole and notch of the substrate board, the space or height of the areas adjacent to the through hole and notch will not be affected or changed. In contrast, in the prior art, the pump is often incautiously flexed in operation to result in unsmooth airflow and malfunction. This problem is apparently improved in the present invention.

It is still a further object of the present invention to provide the above pump structure in which the notch of the substrate board is formed in a position where the second end of the check valve is arranged. The output also can enter the region of the notch without interference from the substrate.

It is still a further object of the present invention to provide the above pump structure in which the substrate board is positioned under the bottom layer of the flexible main body. The substrate board is sandwiched between the flexible main body and an attachment layer to prevent the space between the upper layer and bottom layer of the flexible main body from changing due to bending or other factors. This is different from the conventional pump device, (such as U.S. Pat. No. 5,846,063), that employs a hook-and-loop fastener board for arranging thereon the components made of rigid material.

It is still a further object of the present invention to provide the above pump structure in which the substrate board is positioned under the bottom layer of the flexible main body to support the same. Therefore, the bottom of the pump has a sufficient strength for bearing the stress exerted onto the pump by an operator's fingers in inflation operation. Accordingly, when the flexible main body is compressed, the bottom layer will not irregularly bend or fold due to the pressing force of the operator's fingers in different positions and attitudes as in the prior art. Therefore, affection on the inflation efficiency of the pump device is minimized.

It is still a further object of the present invention to provide the above pump structure in which the output tube has an inlet end and an outlet end. The inlet end communicates with the check valve. The outlet end is connectable with a connector for connecting with the aircushion or bladder.

It is still a further object of the present invention to provide the above pump structure in which the one-way valve is arranged on a bottom wall of the chamber and exposed to outer side. The one-way valve is protected from damage from alien articles. The one-way valve includes at least one valve petal, which is movable between an opened position and a closed position in response to the compression and decompression of the chamber.

It is still a further object of the present invention to provide the above pump structure in which the check valve is composed of two plastic membranes the edges of which are fused with each other. The upper plastic membrane at the first end is adhered to the recessed section formed on the wall of the chamber. Accordingly, the first end of the check valve is formed as an airflow inlet, which is always opened.

The present invention can be best understood through the following description and accompanying drawings wherein:

BRIEF DESCRIPTION OF THE DRAWINGS

FIG. 5-1 is a sectional view according to FIG. 5, showing the arrangement of the first end of the thin membrane-type check valve of the present invention;

DETAILED DESCRIPTION OF THE PREFERRED EMBODIMENTS

Figure 1:
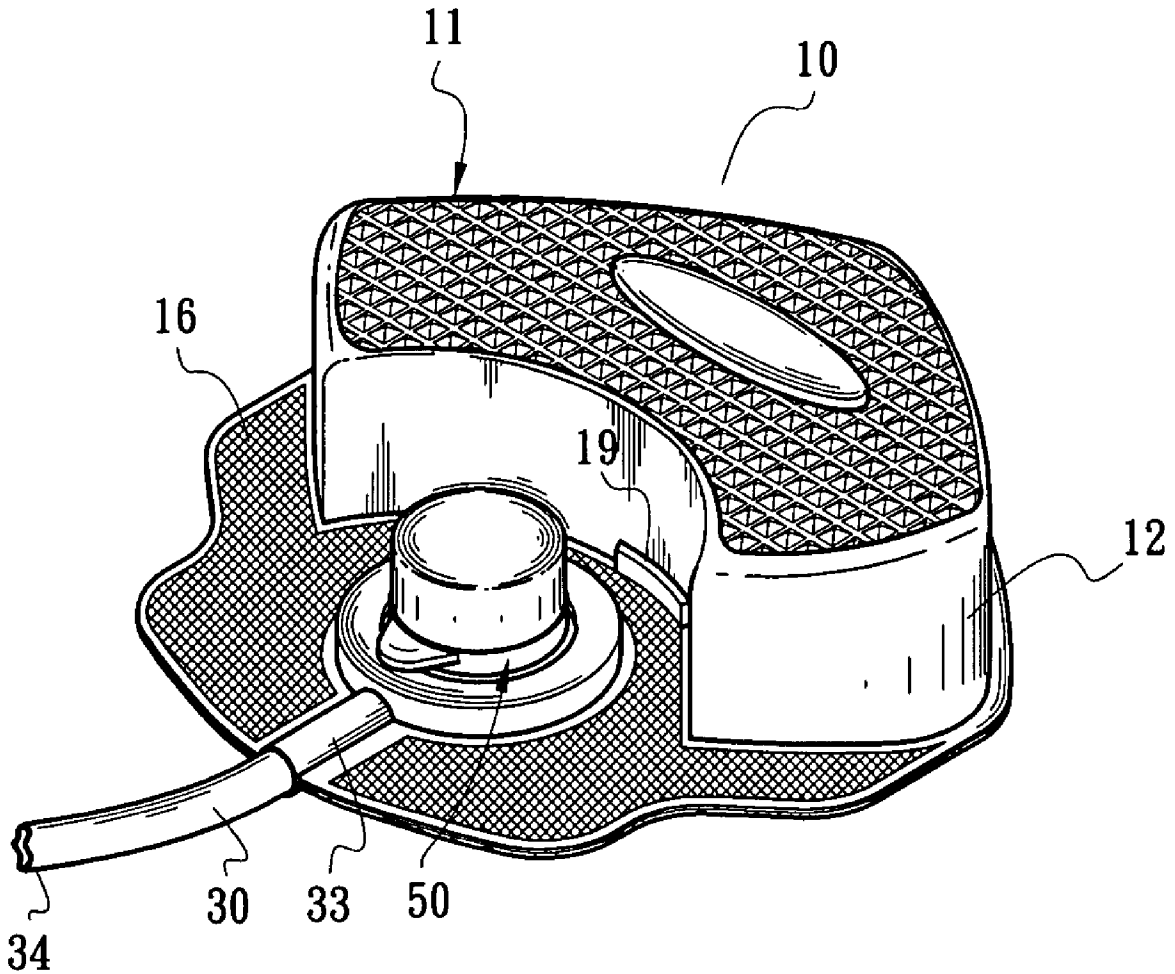
FIG. 1 is a perspective view of the present invention.
Figure 2:
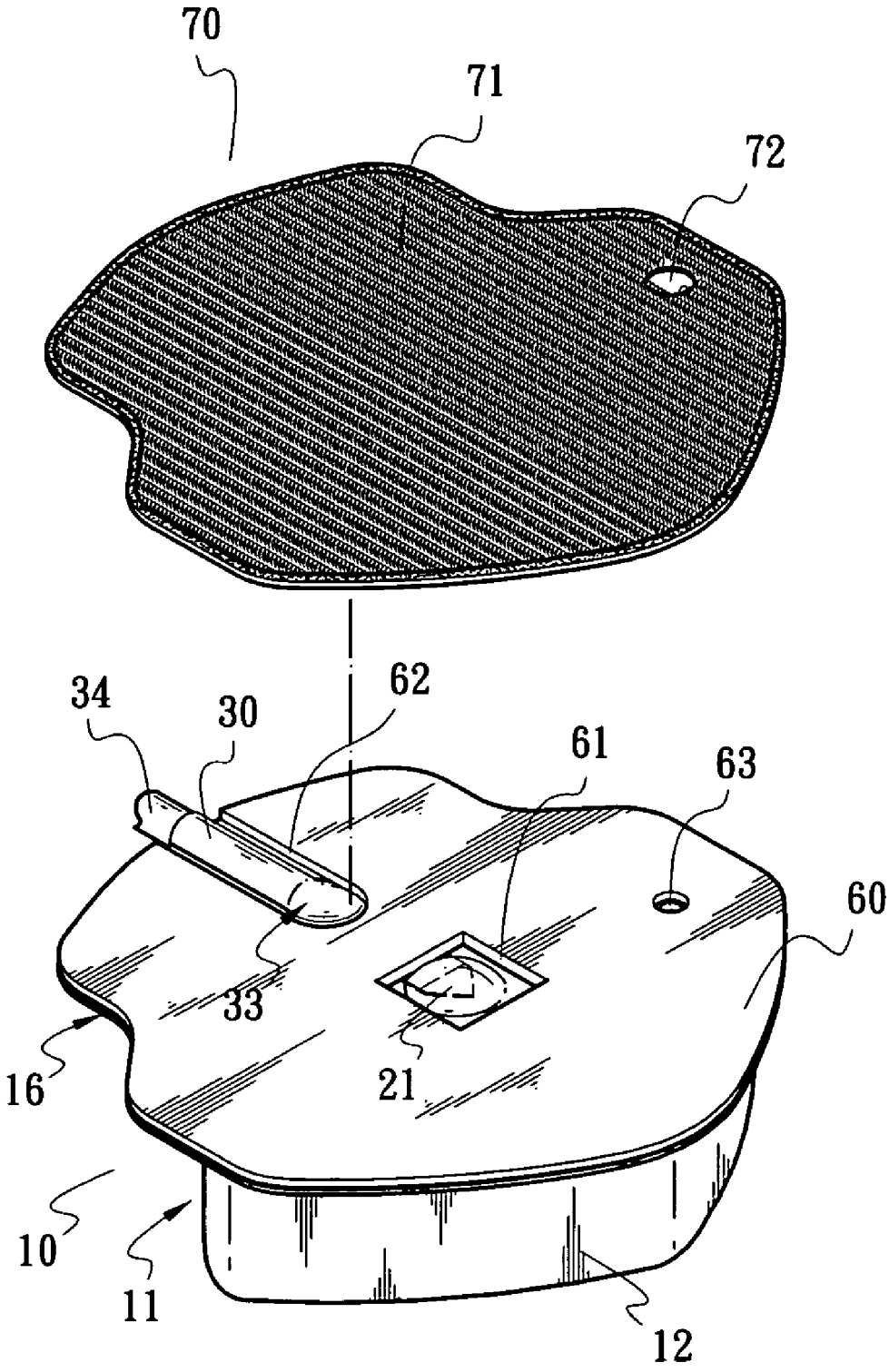
FIG. 2 is a bottom view of the present invention.
Figure 3:
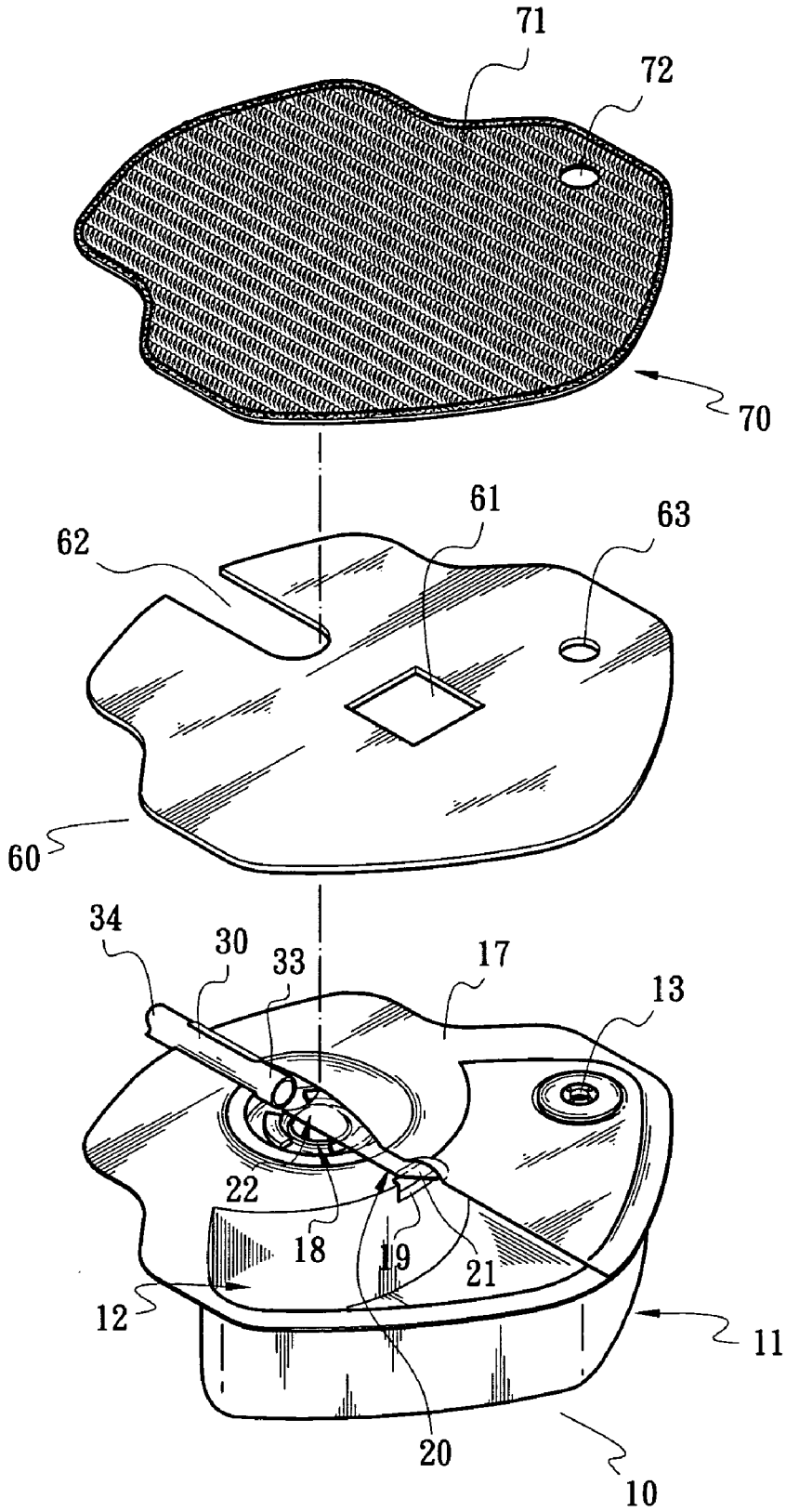
FIG. 3 is a perspective exploded view of the present invention.

Please refer to FIGS. 1, 2 and 3. According to a preferred embodiment of the present invention, the pump structure 10 connectable with an aircushion or a bladder includes a flexible main body 11, a thin membrane-type check valve 20 disposed in the flexible main body 11, an output tube 30 connectable with the flexible main body 11, a relief valve 50 disposed on the flexible main body 11 and a substrate board 60. The flexible main body 11 has an upper layer 16 and a bottom layer 17. The upper layer 16 and the bottom layer 17 together define a chamber 12 and a valve room 18. The chamber 12 is compressible and decompressible to reciprocally contract and expand for sucking in a fluid. The bottom layer 17 preferably has the form of a thin membrane with a thickness smaller than that of the upper layer 16. In this embodiment, the bottom layer 17 is a transparent plastic thin membrane.

Figure 8:
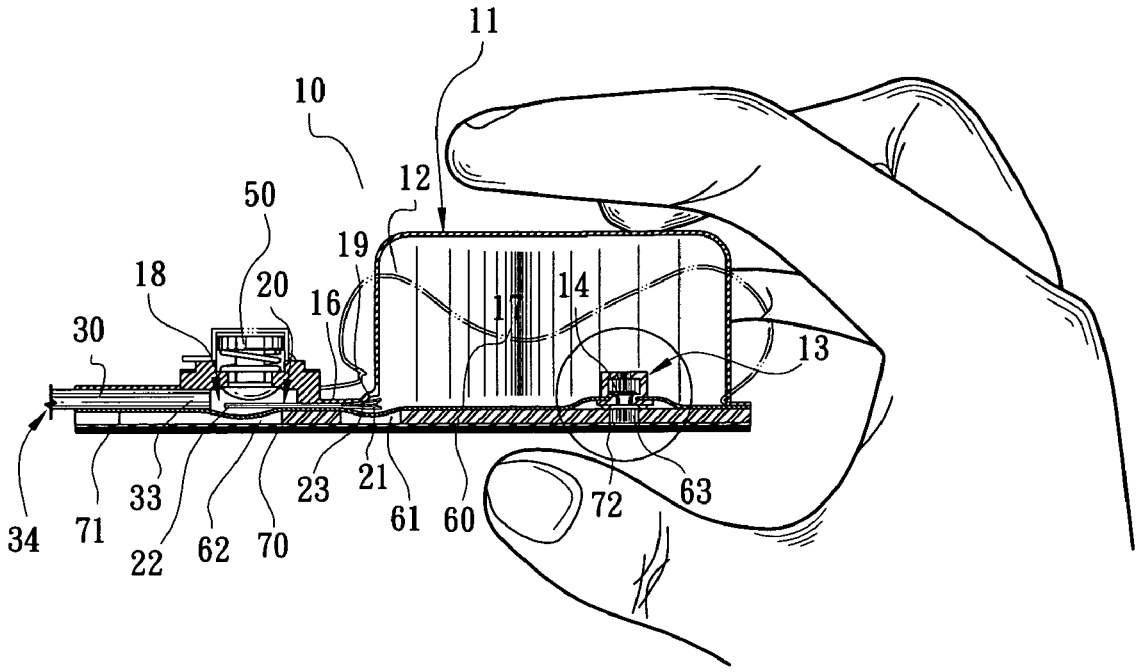
FIG. 8 is a sectional view according to FIG. 4, showing the operation of the present invention in another state, in which the phantom lines show that the chamber is decompressed and restored to suck in airflow.
Figure 9:
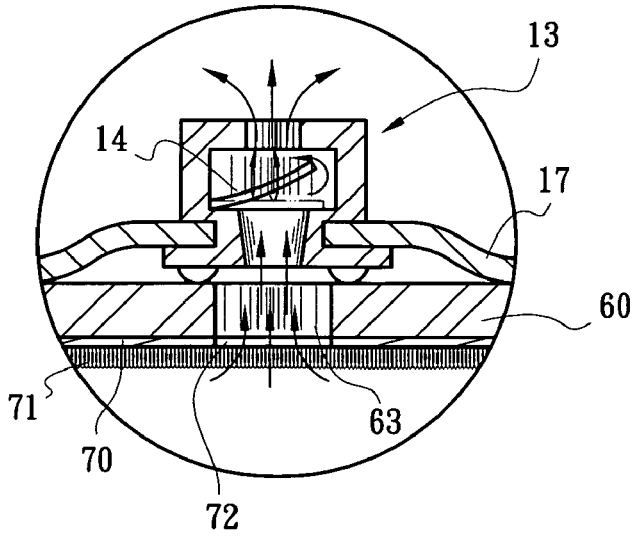
FIG. 9 is an enlarged view of circled area of FIG. 8, showing the operation of the one-way valve.

A one-way valve 13 is mounted on a bottom wall of the chamber 12 as shown in FIG. 3. The one-way valve 13 includes at least one displaceable valve petal 14 (as shown in FIGS. 8 and 9). The valve petal 14 is responsive of the contraction or expansion of the chamber 12 to move between an opened position and a closed position. The one-way valve 13 only permits the fluid to one-way flow into the chamber 12, while preventing the fluid from escaping out through the valve petal 14. (This will be further described hereinafter.)

Figure 4:
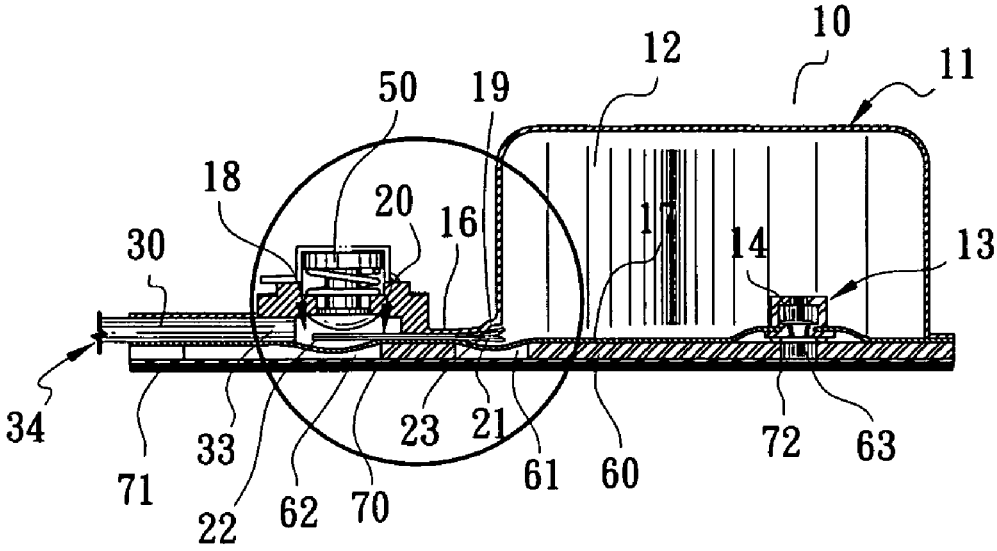
FIG. 4 is a sectional view of the present invention, showing the relationship between the positions of the first and second ends of the thin membrane-type check valve, the flexible main body and the substrate board of the present invention.
Figure 5:
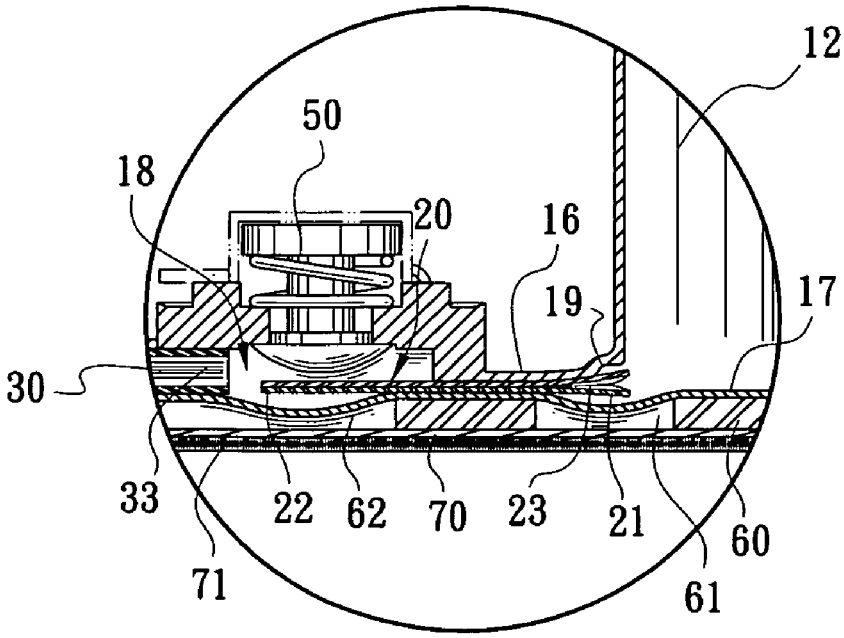
FIG. 5 is an enlarged view of circled area of FIG. 4, showing the chamber, valve room, check valve and bottom layer of the flexible main body of the present invention.
Figures 1, 5:
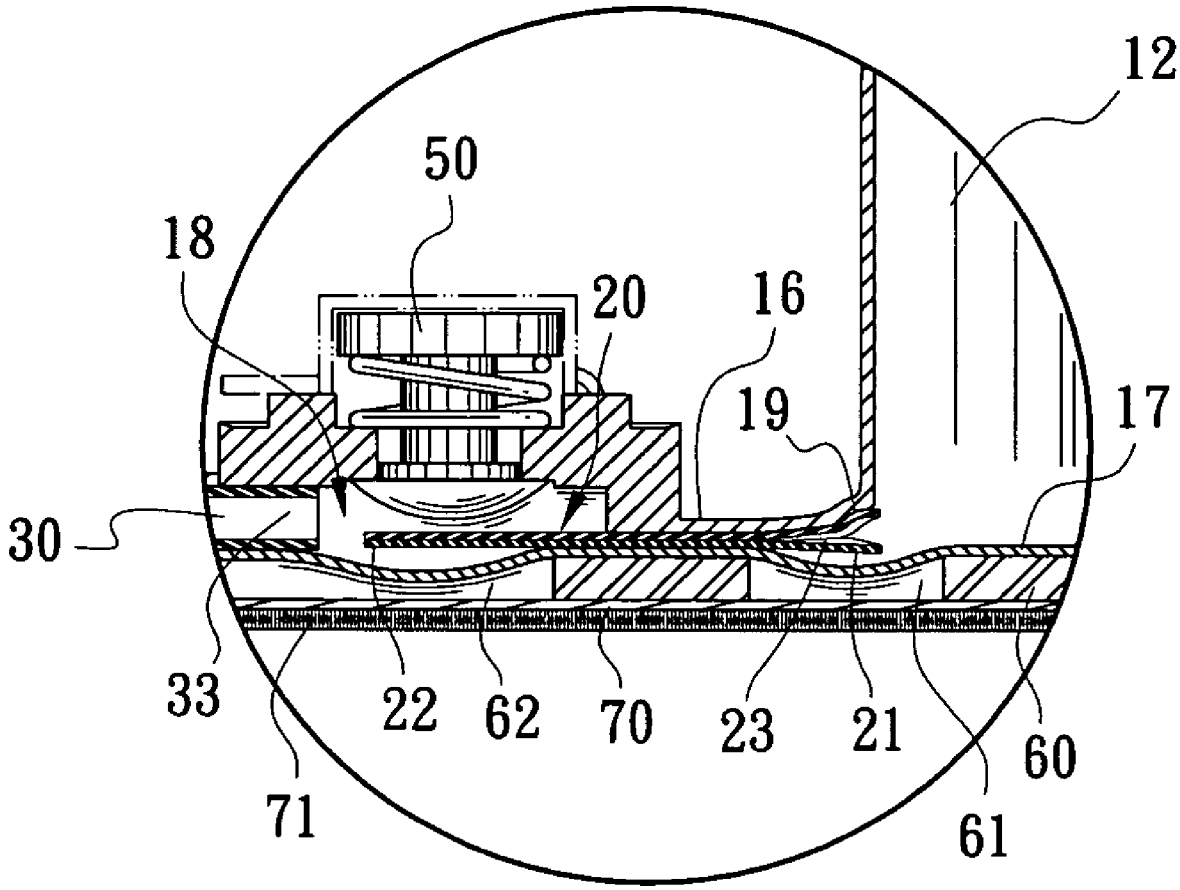

Referring to FIGS. 4 and 5, the thin membrane-type check valve 20 is composed of an upper plastic membrane and a lower plastic membrane the edges of which are fused. The check valve 20 is sandwiched between the upper and bottom layers 16, 17 of the flexible main body 11. The check valve 20 defines a fluid passage 23. The fluid passage 23 has a first end 21 and a second end 22. The first and second ends 21, 22 of the fluid passage 23 are operable between an opened position and a closed position. The first end 21 communicates with the chamber 12. Substantially, the first end 21 has a conic configuration and extends into the chamber 12. Accordingly, the chamber 12 provides a space permitting the first end 21 to be operated between the opened position and closed position. In this embodiment, the second end 22 of the check valve 20 has a concave configuration and communicates with the output tube 30. Accordingly, the fluid coming from the chamber 12 can flow from the first end 21 through the check valve 20 to the second end 22 and then be output from the second end 22.

Referring to FIG. 5-1, according to a preferred embodiment, the thin membrane-type check valve 20 is composed of an upper plastic membrane and a lower plastic membrane the edges of which are fused. The upper plastic membrane at the first end 21 is adhered to a recessed section 19 formed on a wall of the chamber 12. Accordingly, the first end 21 of the check valve is formed as an airflow inlet, which is always opened. Therefore, the thin membrane-type check valve 20 has higher intake and intake efficiency.

As shown in FIGS. 4 and 5, according to a preferred embodiment, the second end 22 of the check valve 20 extends into the valve room 18. The valve room 18 provides a space permitting the second end 22 to be operated between the opened position and closed position. The above structure is characterized in that:

1. For the thin membrane-type check valve 20, the flexible main body 11 provides a space permitting the second end 22 to be operated between the opened position and closed position without interference. In the case that the flexible main body 11 is simply directly formed with a cavity to provide an operation space for the second end 22, an additional processing step is needed. This is not optimal.
2. Originally, the valve room 18 is for installing the relief valve 50 therein. By means of improving the structural design, the second end 22 of the check valve 20 and the relief valve 50 can commonly use the space provided by the valve room 18. Therefore, the additional processing step is unnecessary and the pump structure 10 is simplified.

Referring to FIG. 4, the output tube 30 has an inlet end 33 and an outlet end 34. The inlet end 33 communicates with the valve room 18 and faces the second end 22 of the check valve 20. Accordingly, the fluid coming from the second end 22 of the check valve can be output from the output tube 30. In a preferred embodiment, the outlet end 34 of the output tube 30 is equipped with a detachable connector for connecting with an expandable aircushion or bladder (not shown).

As shown in FIGS. 4 and 5, the relief valve 50 is mounted on the valve room 18 of the flexible main body 11 and positioned above the second end 22 of the check valve. The valve room 18 communicates with the inlet end 33 of the output tube 30 to form a relief passage. When it is desired to exhaust the fluid in the aircushion or the bladder, an operator can press the relief valve 50 to open the same. In this state, the inlet end 33 of the output tube communicates with outer side through the valve room 18.

Referring to FIGS. 3, 4 and 5, in this embodiment, the substrate board 60 is disposed under the bottom layer 17 of the flexible main body 11. Preferably, the substrate board 60 is made of polyethylene (PE) material. The substrate board 60 has a through hole 61 and a notch 62 formed in positions where the first and second ends 21, 22 of the check valve are formed. The output tube 30 or the inlet end 33 can enter the notch 62 without interfering with the substrate board 60. Therefore, the through hole 61 and the notch 62 of the substrate board 60 provide spaces into which the bottom layer 17 of the flexible main body 17 can be recessed as shown in FIGS. 4 and 5. Accordingly, the first and second ends 21, 22 of the thin membrane-type check valve can be opened and closed without interference.

According to the above arrangement, the size of the space defined between the bottom layer 17 and upper layer 16 will not be changed due to operation or other factors. That is, even if the flexible main body 11 is bent, by means of the through hole 61 and notch 62, the areas adjacent to the through hole 61 and notch 62 will not be affected or changed in space or height. In contrast, in the prior art, the pump is often incautiously flexed in operation to result in unsmooth airflow and malfunction. This problem is apparently improved in the present invention.

In a preferred embodiment, the substrate board 60 is disposed under the bottom layer 17 of the flexible main body 11. As shown in FIGS. 3, 4 and 5, the substrate board 60 is sandwiched between the bottom layer 17 of the flexible main body 11 and an attachment layer 70. The attachment layer 70 can be a hook-and-loop (Velcro) fastener having loops 71. Accordingly, in the case that the one-way valve 13 is arranged on the bottom wall of the chamber 12 and exposed to outer side, the one-way valve 13 is protected from damage by alien articles. Also, when the flexible main body 11 is rested on a plane face and pressed/operated, external airflow can go through the gaps between the loops 71 into the one-way valve 13. It should be noted that the substrate board 60 and the attachment layer 70 are respectively formed with perforations 63, 72 in a position where the one-way valve 13 is disposed. Accordingly, the external airflow can go through the attachment layer 70 and the substrate board 60 into the one-way valve 13.

Figure 6:
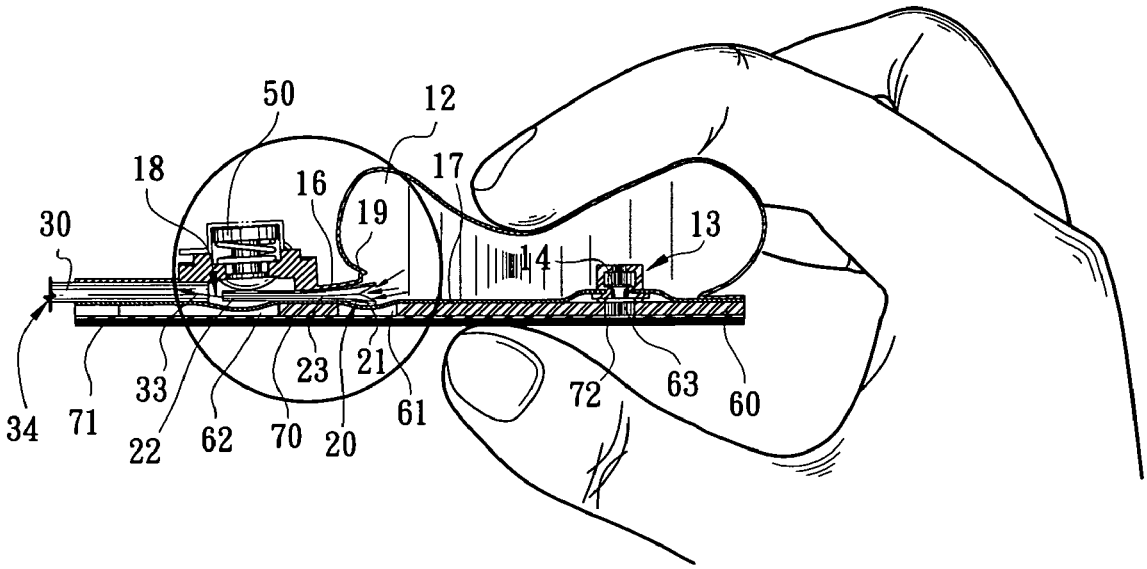
FIG. 6 is a sectional view according to FIG. 4, showing the operation of the present invention.
Figure 7:
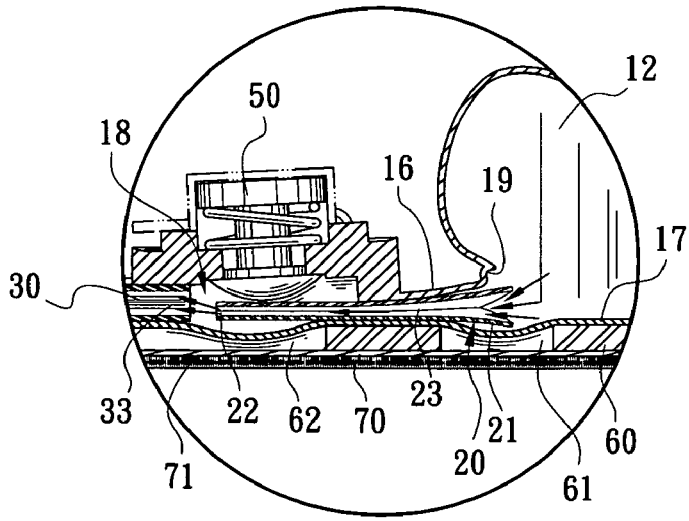
FIG. 7 is an enlarged view of circled area of FIG. 6, showing the operation of the thin membrane-type check valve and the path of airflow.

Referring to FIGS. 4 and 5, when the chamber 12 is in a decompressed state, the second end 22 of the check valve 20 is closed. When an operator compresses the chamber 12 of the flexible main body 11, the fluid therein is forced to flow from the first end 21 of the check valve 20 into the fluid passage 23 to push open the second end 22. The airflow then flows into the inlet end 33 of the output tube into the output tube 30 and delivered into an expandable aircushion or bladder as shown by the arrows of FIGS. 6 and 7.

When the chamber 12 is released from the compressing force, the check valve 20 is blocked and the fluid input to the aircushion or bladder cannot flow back into the chamber 12. In this case, the chamber 12 of the flexible main body 11 expands and restores to its original state. At this time, the external fluid pushes open the valve petal 14 of the one-way valve 13 and flows through the one-way valve 13 into the chamber 12 as shown by the arrows of FIGS. 8 and 9.

It should be noted that when the external fluid is pumped into the chamber 12, due to the pumping force, a negative pressure is created at the first end 21 of the check valve, while a positive pressure is created at the second end 22 of the check valve. In this state, the second end 22 of the check valve 20 is closed. Therefore, the fluid in the aircushion, the bladder or the output tube 30 cannot flow back into the chamber 12. When the operator again compresses the chamber 12, the newly pumped in fluid can again flow through the first end 21 and the fluid passage 23 to open the second end 22 of the check valve and enter the output tube 30 so as to inflate the aircushion or bladder as shown in FIGS. 6 and 7.

Figure 10:
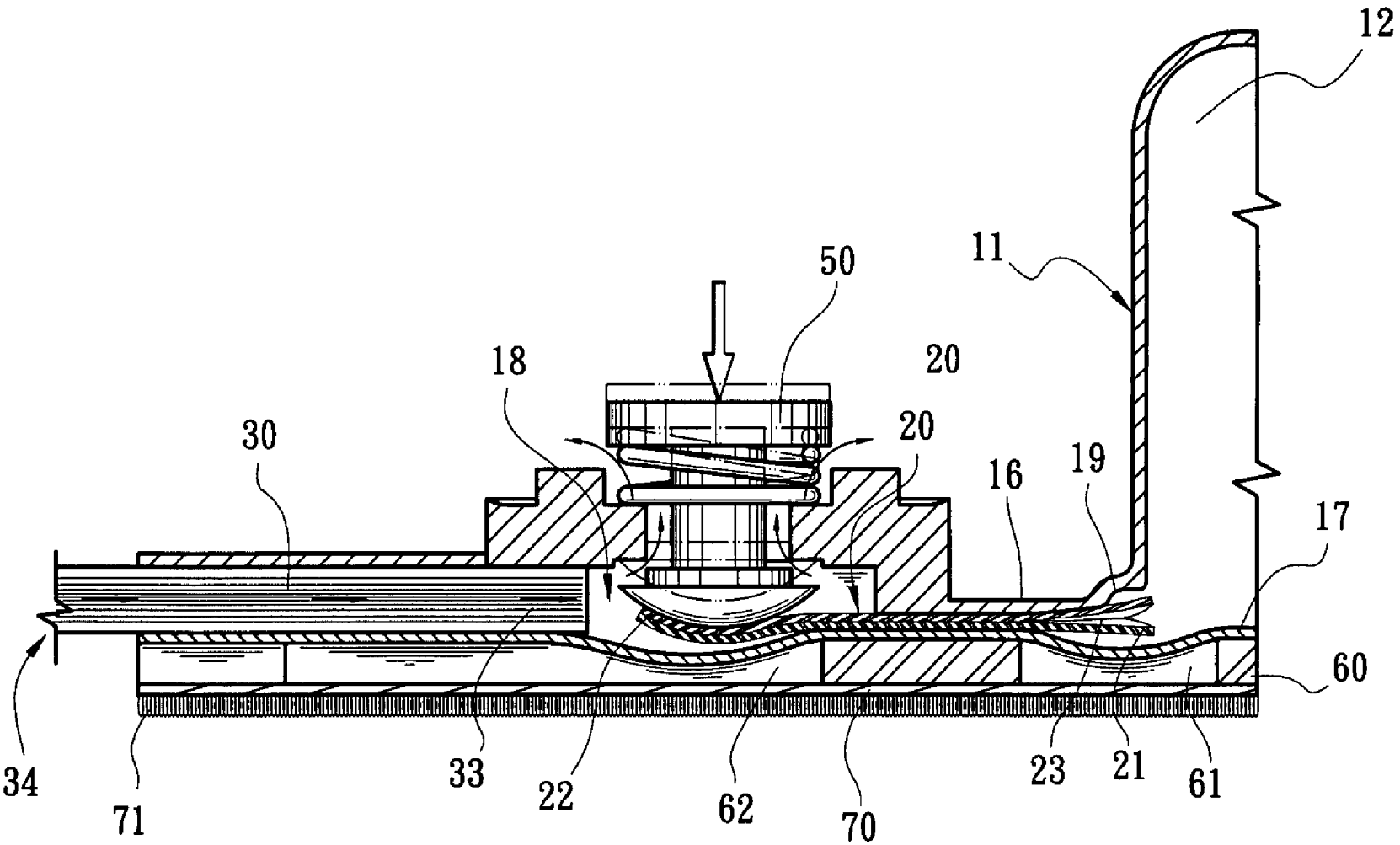
FIG. 10 is a sectional view of the present invention, in which the phantom lines show the operation of the relief valve.

Referring to FIG. 10, when it is desired to deflate the aircushion or bladder, the operator can press the relief valve 50 arranged on the valve room 18 so as to open the relief valve 50. In this state, the output tube 30 communicates with outer side through the valve room 18 as shown by phantom lines of FIG. 10. Under such circumstance, the fluid in the aircushion or bladder can reversely flow through the output tube 30 into the valve room 18 to be exhausted from the relief valve 50 as shown by the arrows of FIG. 10.

It should be noted that the substrate board 60 is positioned under the bottom layer 17 of the flexible main body 11 to support the same. Therefore, the bottom of the pump has a sufficient strength forbearing the stress exerted onto the pump by an operator's fingers in inflation operation. Accordingly, when the flexible main body 11 is compressed, the bottom layer 17 will not irregularly bend or fold due to the pressing force of the operator's fingers indifferent positions and attitudes as in the prior art. Therefore, affection on the inflation efficiency of the pump device is minimized.

Figure 11:
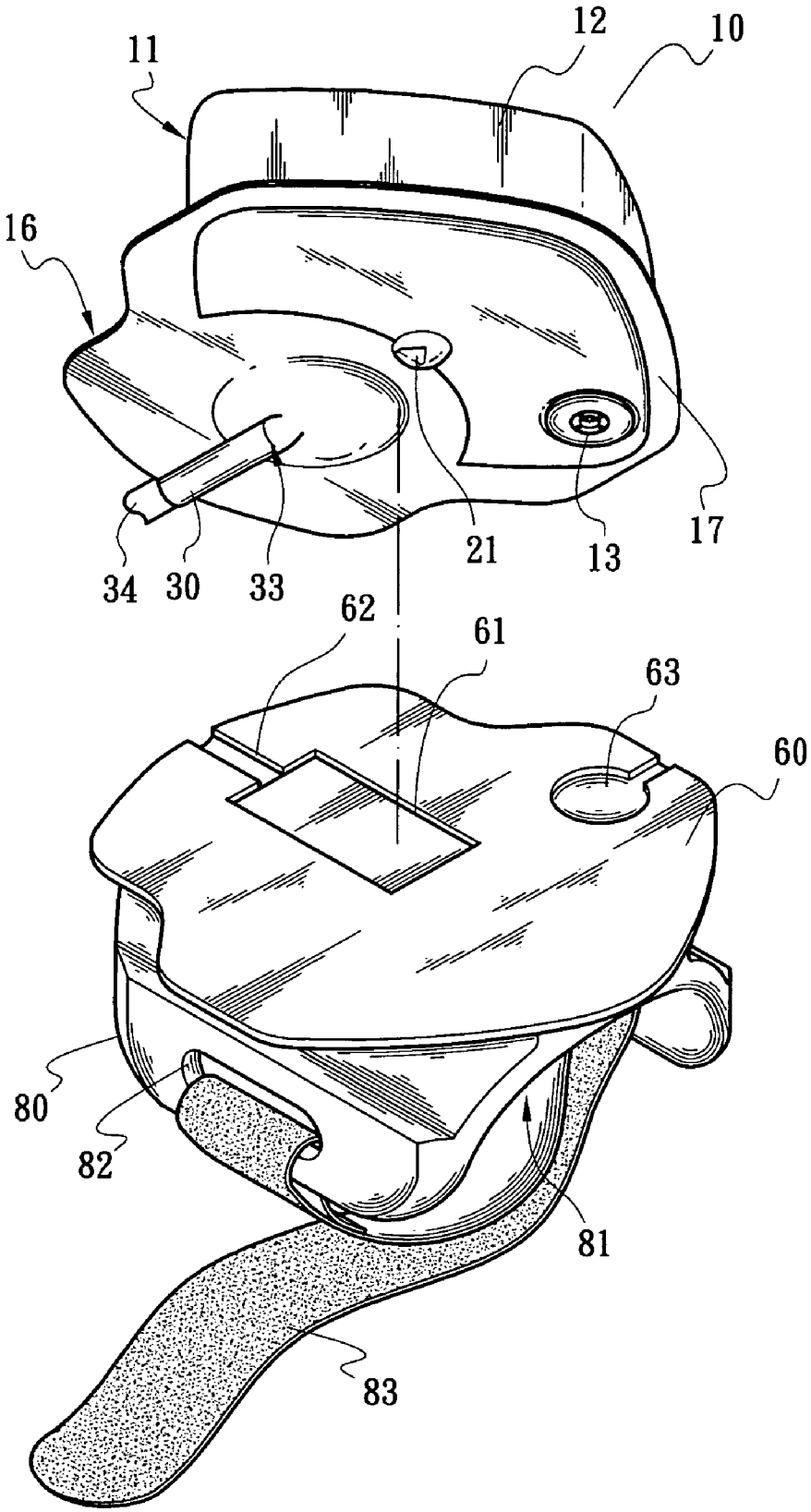
FIG. 11 is a perspective exploded view of another embodiment of the present invention, showing the arrangement of the flexible main body, the substrate board and the seat.

FIG. 11 shows another embodiment of the present invention, in which the substrate board 60 is connected with a seat 80. The substrate board 60 has a flat configuration and is formed with a through hole 61, a notch 62 and a perforation 63. In this embodiment, the seat 80 has an arced section 81 and lug sections 82 formed on the arced section 81. A fastening strap 83 is fastened on the lug sections 82. The arced section 81 has a configuration adapted to a shaft or a rod such as a shaft or a rod of a bicycle frame. The seat 80 can be fixed on a bicycle by means of the fastening strap 83 with the arced section 81 can be attached to the bicycle frame. In this case, it is convenient to use the pump 10 to inflate a saddle of the bicycle.

According to the aforesaid, the pump structure connectable with an aircushion or a bladder of the present invention has the advantages of softness, safety and lightness as in the conventional pump device made of flexible material and employing thin membrane-type check valve, while being free from any defect of the conventional pump device.

In conclusion, the pump structure connectable with an aircushion or a bladder of the present invention has the following characteristics:

1. The upper layer 16 and bottom layer 17 of the flexible main body 11 together define the chamber 12 and the valve room 18. The chamber 12 and the valve room 18 are formed in positions where the first and second ends 21, 22 of the thin membrane-type check valve 20 are formed. Therefore, the first and second ends 21, 22 of the check valve are positioned in the spaces provided by the chamber 12 and the valve room 18 respectively. The first and second ends 21, 22 of the check valve can be operated between opened and closed positions in the spaces without interference. The substrate board 60 is positioned under the flexible main body 11 and formed with the through hole 61 and the notch 62 in positions where the first and second ends 21, 22 of the check valve are formed. This helps in keeping the spaces provided by the flexible main body 11 unchanged.
2. The through hole 61 and notch 62 of the substrate board 60 provide spaces into which the bottom layer 17 of the flexible main body can be recessed. Therefore, the first and second ends 21, 22 of the thin membrane-type check valve can be opened/closed without interference. That is, even if the flexible main body 11 is bent, by means of the through hole 61 and notch 62 of the substrate board 60, the areas adjacent to the through hole 61 and notch 62 will not be affected or changed in space or height. In contrast, in the prior art, the pump is often incautiously flexed in operation to result in unsmooth airflow and malfunction. This problem is apparently improved in the present invention. The present invention is different from the conventional pump device, (such as U.S. Pat. No. 5,846,063), that employs a hook-and-loop fastener board for arranging thereon the components made of rigid material.
3. The substrate board 60 with the through hole 61 and the notch 62 is positioned under the bottom layer 17 of the flexible main body 11 to support the same. Therefore, the bottom of the pump 10 has a sufficient strength for bearing the stress exerted onto the pump by an operator's fingers in inflation operation. Accordingly, when the flexible main body 11 is compressed, the bottom layer 17 will not irregularly bend or fold due to the pressing force of the operator's fingers in different positions and attitudes as in the prior art. Therefore, affection on the inflation efficiency of the pump device is minimized.

4. The upper plastic membrane at the first end 21 is adhered to the recessed section 19 formed on the wall of the chamber 12. Accordingly, the first end 21 of the check valve is formed as an airflow inlet, which is always opened. Therefore, the thin membrane-type check valve 20 has higher intake and intake efficiency.

The above embodiments are only used to illustrate the present invention, not intended to limit the scope thereof. Many modifications of the above embodiments can be made without departing from the spirit of the present invention.

What is claimed is:

1. A pump structure connectable with an aircushion or a bladder, comprising:

a flexible main body defining a valve room and a chamber, a relief valve being arranged in the valve room, the chamber being reciprocally compressible and decompressible to contract and expand for sucking in a fluid;

a one-way valve permitting the fluid to one-way flow into the chamber;

a thin membrane check valve having a first end and a second end, the first and second ends being operable between an open position and a closed position, the first and second ends being respectively positioned in spaces provided by the chamber and the valve room to communicate with the chamber and the valve room; and a substrate board disposed under the flexible main body;

wherein the substrate board has a through hole and a notch formed on positions where the first and second ends of the check valve are formed respectively.

2. The pump structure connectable with the aircushion or bladder as claimed in claim 1, wherein the second end of the check valve communicates with an output tube, the output tube having an inlet end and an outlet end, the inlet end communicating with the second end of the check valve, the outlet end being connectable with a connector for connecting with the aircushion or bladder.

3. The pump structure connectable with the aircushion or bladder as claimed in claim 1, wherein the flexible main body has an upper layer and a bottom layer, the upper layer and bottom layer together defining the chamber and the valve room.

4. The pump structure connectable with the aircushion or bladder as claimed in claim 3, wherein the bottom layer of the flexible main body has the form of a thin membrane.

5. The pump structure connectable with the aircushion or bladder as claimed in claim 3, wherein the bottom layer of the flexible main body has a thickness smaller than that of the upper layer.

6. The pump structure connectable with the aircushion or bladder as claimed in claim 3, wherein the bottom layer of the flexible main body is a thin transparent plastic membrane.

7. The pump structure connectable with the aircushion or bladder as claimed in claim 3, wherein the one-way valve is disposed on a bottom wall of the chamber, the one-way valve including a valve petal movable between an open position and a closed position.

8. The pump structure connectable with the aircushion or bladder as claimed in claim 3, wherein the check valve is composed of two plastic membranes, the edges of which are fused with each other to define a fluid passage, the check valve being sandwiched between the upper layer and bottom layer of the flexible main body.

9. The pump structure connectable with the aircushion or bladder as claimed in claim 1, wherein the relief valve is positioned above the second end of the check valve.

10. The pump structure connectable with the aircushion or bladder as claimed in claim 1, wherein the substrate board made of polyethylene (PE) material.

11. The pump structure connectable with the aircushion or bladder as claimed in claim 2, wherein the inlet end of the output tube extends into a region of the notch of the substrate board.

12. The pump structure connectable with the aircushion or bladder as claimed in claim 3, wherein the bottom layer of the flexible main body can be partially recessed into the through hole and the notch of the substrate board.

13. The pump structure connectable with the aircushion or bladder as claimed in claim 1, wherein the substrate board is sandwiched between the flexible main body and an attachment layer.

14. The pump structure connectable with the aircushion or bladder as claimed in claim 13, wherein the attachment layer is a hook-and-loop fastener.

15. The pump structure connectable with the aircushion or bladder as claimed in claim 1, wherein the substrate board has a perforation formed in a position where the one-way valve is arranged.

16. The pump structure connectable with the aircushion or bladder as claimed in claim 13, wherein the attachment layer has a perforation formed in a position where the one-way valve is arranged.

17. The pump structure connectable with the aircushion or bladder as claimed in claim 1, wherein the substrate board is connected with a seat, the seat having an arced section and lug sections formed on the arced section, a fastening strap being fastened on the lug sections.

18. The pump structure connectable with the aircushion or bladder as claimed in claim 1, wherein the thin membrane check valve is composed of an upper plastic membrane and a lower plastic membrane the edges of which are fused with each other, the upper plastic membrane at the first end being adhered to a recessed section formed on a wall of the chamber, whereby the first end of the check valve is formed as an airflow inlet.

19. The pump structure connectable with the aircushion or bladder as claimed in claim 1, wherein the first end of the thin membrane check valve has a conic configuration, while the second end of the thin membrane check valve has a concave configuration.

* * * * *